US008405521B2

(12) United States Patent
Fujiwara et al.

(10) Patent No.: US 8,405,521 B2
(45) Date of Patent: Mar. 26, 2013

(54) APPARATUS AND METHOD FOR GENERATING STATISTIC TRAFFIC INFORMATION

(75) Inventors: Junsuke Fujiwara, Hitachinaka (JP); Takumi Fushiki, Hitachi (JP)

(73) Assignee: Clarion Co., Ltd., Tokyo (JP)

( * ) Notice: Subject to any disclaimer, the term of this patent is extended or adjusted under 35 U.S.C. 154(b) by 263 days.

(21) Appl. No.: 12/823,717

(22) Filed: Jun. 25, 2010

(65) Prior Publication Data

US 2010/0328100 A1 Dec. 30, 2010

(30) Foreign Application Priority Data

Jun. 26, 2009 (JP) ..... 2009-151857

(51) Int. Cl.
*G08G 1/09* (2006.01)
*G08G 1/00* (2006.01)
*G08G 1/065* (2006.01)

(52) U.S. Cl. ..... 340/905; 340/901; 340/934; 701/117

(58) Field of Classification Search ..... 340/933–938, 340/995.1–995.28; 701/117–119, 409–471
See application file for complete search history.

(56) References Cited

U.S. PATENT DOCUMENTS

| | | | | |
|---|---|---|---|---|
| 7,580,788 | B2 | 8/2009 | Hiruta et al. | |
| 2005/0093720 | A1* | 5/2005 | Yamane et al. | 340/995.13 |
| 2005/0231394 | A1* | 10/2005 | Machii et al. | 340/995.13 |
| 2006/0064234 | A1 | 3/2006 | Kumagai et al. | |
| 2008/0046165 | A1 | 2/2008 | Downs et al. | |
| 2008/0175161 | A1* | 7/2008 | Amemiya et al. | 370/252 |

FOREIGN PATENT DOCUMENTS

| | | | |
|---|---|---|---|
| EP | 1 887 319 | A1 | 2/2008 |
| JP | 11-211491 | A | 8/1999 |
| JP | 2005-122461 | A | 5/2005 |
| JP | 2005-308581 | A | 11/2005 |
| JP | 2008-40600 | A | 2/2008 |
| JP | 2008-123145 | A | 5/2008 |
| JP | 2008-146167 | A | 6/2008 |
| JP | 2009-87097 | A | 4/2009 |

OTHER PUBLICATIONS

Bowen Du et al., Missing Data Compensation Model in Real-Time Traffic Information Service System, Fuzzy Systems and Knowledge Discovery, 2008. FSKD '08. Fifth International Conference on, IEEE, Piscataway, NJ, USA, Oct. 18, 2008, pp. 371-378, XP031357960.
European Search Report dated Nov. 9, 2010 (seven (7) pages.
Japanese Office Action dated Oct. 25, 2011 (two (2) pages).

* cited by examiner

*Primary Examiner* — Hai Phan
*Assistant Examiner* — Ojiako Nwugo
(74) *Attorney, Agent, or Firm* — Crowell & Moring LLP

(57) ABSTRACT

A statistic DB creation processing section creates a statistic traffic DB, based on past actual traffic data (probe DB or VICS DB), and stores it in a statistic DB storage section. A reference-link-candidate extraction processing section extracts a complement target link (temporal missing link) from the statistic traffic DB, and further extracts complementary-reference-link-candidates for the complement target link, according to plural extraction rules to extract complementary-reference-link-candidates. A complement-evaluation application processing section calculates correlation coefficients of the statistic traffic data of the complementary-reference-link-candidates to the statistic traffic data of the complement target link for the respective extraction rules, assigns a priority order to the extraction rules in the order of higher correlation coefficient, and complements the missing data of the statistic traffic data of the complement target link by the use of the statistic traffic data of the complementary reference link extracted by the extraction rule of the highest priority.

8 Claims, 13 Drawing Sheets

FIG.2

120 Probe DB (130 VICS DB)

| Date | Link ID | Link length | Link travel time | | | |
|---|---|---|---|---|---|---|
| | | | 0:00 | 0:05 | ••• | 23:55 |
| 2006/7/8 | 123456 | 800 | 8.0 | 8.1 | ••• | 8.2 |
| ⋮ | ⋮ | ⋮ | ⋮ | ⋮ | ⋮ | ⋮ |
| 2006/7/9 | 123456 | 800 | 8.1 | 7.9 | ••• | 8.1 |
| ⋮ | ⋮ | ⋮ | ⋮ | ⋮ | ⋮ | ⋮ |

FIG.4

140 Day-type calendar storage section

| Date | Day of week | Day type |
|---|---|---|
| ⋮ | ⋮ | ⋮ |
| 2006/7/8 | Saturday | Day type 4 (holiday 1) |
| 2006/7/9 | Sunday | Day type 5 (holiday 2) |
| 2006/7/10 | Monday | Day type 1 (weekday 1) |
| 2006/7/11 | Tuesday | Day type 2 (weekday 2) |
| 2006/7/12 | Wednesday | Day type 2 (weekday 2) |
| 2006/7/13 | Thursday | Day type 2 (weekday 2) |
| 2006/7/14 | Friday | Day type 3 (weekday 3) |
| 2006/7/15 | Saturday | Day type 4 (holiday 1) |
| 2006/7/16 | Sunday | Day type 5 (holiday 2) |
| 2006/7/17 | Monday | Day type 1 (weekday 1) |
| ⋮ | ⋮ | ⋮ |

160 Statistic DB storage section

| Day type | Link ID | Link length | Statistic travel time | | | |
|---|---|---|---|---|---|---|
| | | | 0:00 | 0:05 | ··· | 23:55 |
| Day type (weekday 1) | 123456 | 800 | 8.04 | 8.01 | ··· | 8.22 |
| ⋮ | ⋮ | ⋮ | ⋮ | ⋮ | ⋮ | ⋮ |
| Day type (weekday 2) | 123456 | 800 | 8.12 | 7.90 | ··· | 8.15 |
| ⋮ | ⋮ | ⋮ | ⋮ | ⋮ | ⋮ | ⋮ |

FIG.7

180 Complementary-reference-link candidate extraction-rule storage section

| Rule ID | Target road | Extraction condition | | | | |
|---|---|---|---|---|---|---|
| | | Mesh | Road type | Connection relation | Link angle [degree] | Midpoint distance [m] |
| 1 | Same road | 0 | 1 | 1 | – | 1000 |
| 2 | Parallel road | 0 | 1 | – | 45 | 5000 |
| 3 | Surrounding area | 1 | 1 | – | – | – |
| ⋮ | ⋮ | ⋮ | ⋮ | ⋮ | ⋮ | ⋮ |

FIG.11A Example of processing in step S66
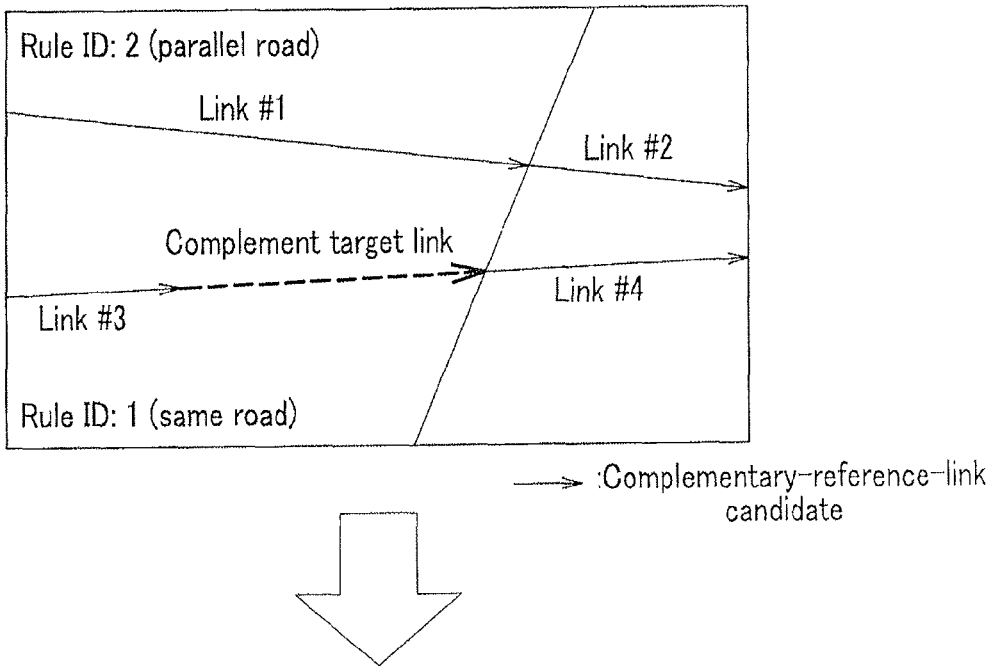
FIG.11B Example of processing in step S67
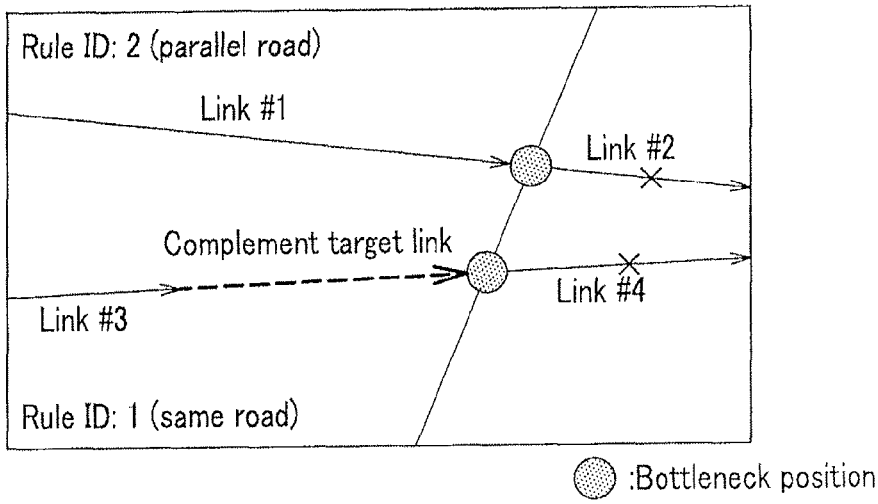

FIG.13

| | Day type 1 | | | | | ... |
|---|---|---|---|---|---|---|
| | Before dawn | Morning | Daytime | Evening | Night | ... |
| Complement rule ID: 1 | 1 | 2 | 1 | 3 | 3 | ... |
| Complement rule ID: 2 | 2 | 1 | 2 | 1 | 1 | ... |
| Complement rule ID: 3 | 3 | 3 | 3 | 2 | 2 | ... |
| ⋮ | ⋮ | ⋮ | ⋮ | ⋮ | ⋮ | ⋮ |

APPARATUS AND METHOD FOR GENERATING STATISTIC TRAFFIC INFORMATION

CROSS REFERENCE TO RELATED APPLICATION

The application claims the foreign priority benefit under Title 35, United States Code, $119(a)-(d) of Japanese Patent Application No. 2009-151857, filed on Jun. 26, 2009, the contents of which are hereby incorporated by reference.

BACKGROUND OF THE INVENTION

1. Field of the Invention

The present invention relates to an apparatus and method for generating statistic traffic information that generate statistic traffic data of a road link, whose statistic traffic data is partially missing, with complement based on statistic traffic data of another road link.

2. Description of the Related Art

In general, a car navigation apparatus holds, not only map information on roads, but also statistic traffic data, which is generated based on actual traffic information regarding the past congestion statuses and link travel times in the respective sections (hereinafter, referred to as road links or merely as links) of roads. Statistic traffic data is information generated by sorting past actual traffic information (primarily link travel times) by the categories of day types, such as a weekday, a holiday, a holiday season, and the like, in each of which the traffic dynamics of a day are similar, and then averaging the sorted past actual traffic information. Thus, using statistic traffic data, a car navigation apparatus can obtain the shortest-time path to a destination averagely with the most certainty, corresponding to the day type, a time zone, or the like of a day.

Incidentally, actual traffic information to be a basis of such statistic traffic data can be obtained in Japan from VICS (registered trademark: Vehicle Information and Communication System) or a floating car. VICS is a system that online collects traffic information obtained from a vehicle sensor (hereinafter, referred to as a roadside sensor) or the like installed by a road administrator or the like, and aggregates the collected traffic information and provides the aggregated information to running vehicles and the like. A floating car is a vehicle dedicated to collecting traffic information, and actually measures, for example, the link travel time of a road through actual running on the road.

VICS cannot obtain traffic information on a road link on which a roadside sensor is not installed. On the other hand, a floating car can obtain traffic information also on a road on which VICS cannot obtain traffic information, however, a floating car can hardly obtain traffic information neither on all roads nor over all time zones. Consequently, statistic traffic data on respective road links may be missed in some time zones, for example.

For example, when a link travel time is missing even for a part of road links, it is not possible to run on these road links, and neither to accurately obtain the shortest-time path nor to accurately estimate the time required to get to a destination because an accurate link travel time is not set.

In this situation, in order to eliminate such inconvenience, a technology has been devised (for example, refer to Japanese Patent Application Laid-Open No. 2005-122461), which complements missing statistic traffic data, by referring to a connection relation, a position relation, or the like between roads. According to this technology, statistic traffic data of a road link having a missing in statistic traffic data (hereinafter, referred to as a complement target link) can be estimated (complemented) based on the statistic traffic data of another road link on the same route or that on a route in parallel, which is considered to be similar to the complement target link in traffic dynamics, in other words, to have a high degree of correlation. In this situation, the road link whose statistic traffic data is used for compliment is referred to as a complementary reference link.

FIG. 14 is a diagram showing an example of a temporal-missing link being a complement target link, and the statistic traffic data of the temporal-missing link. In FIG. 14A, the dashed line with an arrow shows a temporal-missing link (complement target link). Further, as examples of complementary reference links for the temporal-missing link, link #1 on a parallel route and link #2 on the same route are shown.

The graphs in FIGS. 14B to 14D show the variation in statistic traffic data on the respective road links (in this case, the average running speed of a vehicle on the respective road links) between 0 o'clock and 24 o'clock. The statistic traffic data of the respective links is assumed to include data such as the average running speed (corresponding to the link travel time) for each clock time of a day and the like, and if data is missing at a part of the clock times of a link, the link is referred to as a temporal-missing link.

In a conventional technology, if plural complementary reference links having statistic traffic data are present on the same route and/or a parallel route/routes, a complementary reference link is determined according to the priority order which is predetermined and fixed. For example, in a case where another link having statistic traffic data is present on the same route, the statistic traffic data of a complement target link is complemented by the use of the statistic traffic data of the link on the same route with the highest priority, while in a case where another link having statistic traffic data is absent on the same route, the statistic traffic data of a complement target link is complemented by the use of the statistic traffic data of a link on a parallel route. Further, in a case where a link having statistic traffic data is absent on none of such routes, the statistic traffic data of a complement target link is complemented by the use of the statistic traffic data of a link present in the surrounding area.

SUMMARY OF THE INVENTION

Problem to be Solved by the Invention

However, the degree of correlation of a complement target link with the statistic traffic data is not always higher for the statistic traffic data of a link of the same route than for the statistic traffic data of a link of a parallel route. Depending on the day type, the time zone, and the place, the degree of correlation can be higher for the statistic traffic data of a link on a parallel route. In a conventional technology, it is not possible to complement the statistic traffic data of a complement target link, addressing such a case.

That is, in a conventional technology, as the priority order, with which a rule for extracting a complementary reference link is applied, is predetermined and fixed, there is a possibility that the statistic traffic data of a complement target link (temporal-missing link) is complemented by the use of the statistic traffic data of a complementary reference link, which does not necessarily have a high degree of correlation, depending on the data type, the time zone, and the place. As a result, the accuracy of the statistic traffic data of the complemented complement target link (temporal-missing link) drops.

Addressing the above-described problem of the conventional technology, an object of the invention is to provide a statistic traffic information generating apparatus and a method for the same capable of complementing the statistic traffic data of a complement target link (temporal-missing link) with a higher accuracy.

Means for Solving the Problem

According to the present invention, there is provided a statistic traffic information generating apparatus which includes a storage unit that stores statistic traffic data corresponding to road links; an extraction unit that detects a road link whose statistic traffic data is partially missing; a complement rule storage unit that stores complement rules to adopt a road link corresponding to statistic traffic data to be used to complement the missing statistic traffic data; a candidate link extraction unit that extracts links to be candidates that complement the road link extracted by the extraction unit, according to the complement rules stored in the complement rule storage unit; a calculation unit that calculates similarities between the road link extracted by the extraction unit and the respective road links to be candidates for complement, for the respective complement rules stored in the complement rule storage unit, the candidates being extracted by the candidate link extraction unit; a priority order assignment unit that assigns a priority order to the complement rules stored in the complement rule storage unit, according to the similarities calculated by the calculation unit; a complementary link extraction unit that extracts a complementary link for complement of the missing statistic traffic data, using a complement rule based on the priority order assigned by the priority order assignment unit; and a complement unit that complements the missing statistic traffic data in the statistic traffic data that corresponds to the road link extracted by the extraction unit, using statistic traffic data that corresponds to the link extracted by the complementary link extraction unit.

According to the invention, for each road link whose statistic traffic data is partially missing, the similarities of the statistic traffic data of road links extracted by respective rules for extracting a complementary link, to the statistic traffic data of the road link whose statistic traffic data is partially missing, are calculated for the respective rules for extracting a complementary link. Then, the statistic traffic data of the road link whose statistic traffic data is partially missing is complemented, using the statistic traffic data of a road link extracted by a rule having a large similarity. That is, since the statistic traffic data of the road link extracted by the rule having a large similarity is used to complement the statistic traffic data of the road link whose statistic traffic data is partially missing, the accuracy of complement is improved.

According to the present invention, missing data of the statistic traffic data of a complement target link (temporal-missing link) can be complemented with a higher accuracy.

BRIEF DESCRIPTION OF THE DRAWINGS

FIG. 2 is a diagram showing an example of a record structure of probe DB and VICS DB;

FIG. 4 is a diagram showing an example of a record structure of a day type calendar stored in a day type calendar storage section;

FIG. 7 is a diagram showing an example of a record structure in a complementary-reference-link candidate extraction rule storage section;

FIGS. 11A and 11B are diagrams showing the state that complementary-reference-link candidates are extracted in the reference-link candidate extraction processing in FIG. 10 and subjected to filtering;

FIG. 13 is a diagram showing an example of a table of priority orders in applying complement rules for respective time zones.

DETAILED DESCRIPTION OF THE PREFERRED EMBODIMENT

Figure 1:
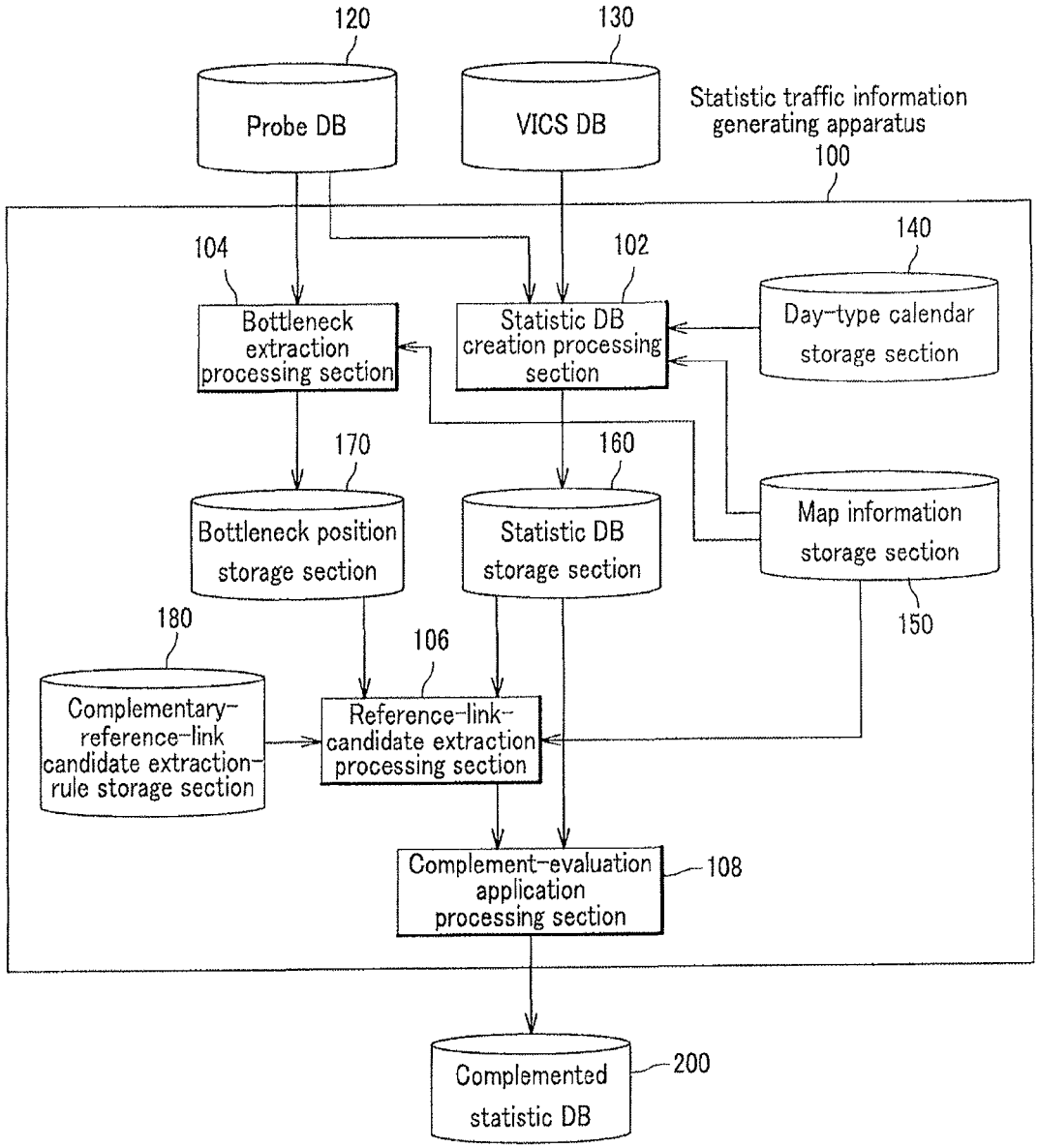
FIG. 1 is a diagram showing function blocks of a statistic traffic information generating apparatus in an embodiment in accordance with the invention.

An embodiment in accordance with the present invention will be described below in detail, referring to the drawings.

FIG. 1 is a diagram showing the function blocks of a statistic traffic information generating apparatus 100 in an embodiment in accordance with the invention. As shown in FIG. 1, the statistic traffic information generating apparatus 100 includes a statistic DB (Database) creation processing section 102, a bottleneck extraction processing section 104, a reference-link-candidate extraction processing section 106, a complement-evaluation application processing section 108, a day-type calendar storage section 140, a map information storage section 150, a statistic DB storage section 160, a bottleneck position storage section 170, and a complementary-reference-link candidate extraction-rule storage section 180.

Herein, the statistic traffic information generating apparatus 100 is configured by a computer provided with a central processing unit (hereinafter, referred to as CPU), not shown, a storage device, not shown, having a semiconductor memory, a hard disk unit, and the like. The CPU executes certain programs stored in the storage device to implement the functions of the respective processing sections 102, 104, 106, and 108. The respective storage sections 140, 150, 160, 170, and 180 are arranged on the above-described storage device.

The statistic traffic information generating apparatus 100 may form a part of a car navigation system (not shown) mounted on a vehicle, or may form a part of a traffic information providing center (not shown) that provides traffic information via a communication network to car navigation systems.

As input data to the statistic traffic information generating apparatus 100, data which is output from a probe DB 120 and VICS DB 130 is input. Complemented statistic traffic data is output from the statistic traffic information generating apparatus 100 and then stored into a complemented statistic DB 200. Here, probe DB 120 is a database of traffic information that is collected based on results of running by a floating car and accumulated. Hereinafter, output data from the probe DB 120 will be referred to as probe data. VICS DB 130 is a database which is accumulation of traffic information provided by VICS. Hereinafter, output data from the VICS DB 130 will be referred to as VICS data.

FIG. 1 shows a structure where probe DB 120, a VICS DB 130, and a complemented statistics DB 200 are not contained in the statistic traffic information generating apparatus 100, however, the statistic traffic information generating apparatus 100 may contain these databases.

Next, functions of the respective function blocks of the statistic traffic information generating apparatus 100 will be briefly described. Incidentally, the details of the functions will be sequentially described later, referring to the drawings of FIG. 3 and after.

In FIG. 1, the statistic DB creation processing section 102 obtains probe data from the probe DB 120 and VICS data from the VICS DB 130; sort the obtained probe data and the VICS data by day type of past dates, each day type being defined by a day type calendar stored in the day-type calendar storage section 140; performs statistic processing to create statistic traffic data; and stores the statistic traffic data in the statistic DB storage section 160. Incidentally, the statistic traffic data stored in the statistic DB storage section 160 will also be referred to as statistic DB generically hereinafter.

Based on the probe data of the probe DB 120 and the map information stored in the map information storage section 150, the bottleneck extraction processing section 104 compares the traffic congestion occurrence frequencies between links in connection relation to each other, thereby extracts bottleneck positions to be the origins of congestion occurrence, and stores information on nodes of the extracted bottleneck positions in the bottleneck position storage section 170.

The reference-link-candidate extraction processing section 106 refers to the statistic traffic data of respective links stored in the statistic DB storage section 160, and extracts links whose statistic traffic data is missing in a part of time zones or at a part of clock times of a day, as complement target links. Further, according to several extraction rules that are set in advance and stored in the complementary-reference-link candidate extraction-rule storage section 180, the reference-link-candidate extraction processing section 106 extracts links which can become candidates (hereinafter, referred to as complementary-reference-link candidates) for complementary reference links that are necessary to complement the missing statistic traffic data of the respective complement target links.

Incidentally, in the present embodiment, when extracting complementary-reference-link candidates, the reference-link-candidate extraction processing section 106 further refers to the bottleneck position information stored in the bottleneck position storage section 170, and eliminates inappropriate links as complementary-reference-link candidates, which will be described later in detail.

For each day type and time zone, the complement-evaluation application processing section 108 calculates the degree of correlation between the statistic traffic data of each of plural complementary-reference-link candidates and significant statistic traffic data of the above-described respective complement target link, the candidates being extracted by the reference-link-candidate extraction processing section 106 according to respective complementary-reference-link candidate extraction rules. Then, the complement-evaluation application processing section 108 determines a priority order of the respective extraction rules of extracting a complementary-reference-link candidate, according to the degree of correlation. Further, the complement-evaluation application processing section 108 uses the statistic traffic data of the complementary-reference-link candidate extracted by the extraction rule determined by the priority order, thereby complements traffic information for the time zone or the clock time for which traffic information was missing in the complement target link, and stores the complement traffic information in the complemented statistic DB 200.

Incidentally, the degrees of correlation referred to herein are indexes representing the similarities or resemblances between the statistic traffic data of a complement target link and the statistic traffic data of plural complementary-reference-link candidates. In the present embodiment, so-called correlation coefficients are used as described later. However, the degree of correlation is not limited to a correlation coefficient as long as it is an index representing the similarity or resemblance, and may be, for example, an inverse (because, the closer the former data and the latter data are to each other, the smaller the value is, in a case of a relative error) of a relative error of the statistic traffic data of a complementary-reference-link candidate with respect to the statistic traffic data of a complement target link.

FIG. 2 is a diagram showing an example of a record structure of the probe DB 120 and the VICS DB 130. In the present embodiment, as shown in FIG. 2, it is assumed that the probe DB 120 and the VICS DB 130 have the same record structure, in which a record is formed of fields for a date, a link ID, a link length, a link travel time at respective clock times, and the like.

Herein, years, months, and dates when link travel times, which are stored in a field for the link travel time, were obtained are stored in a field for the date. Further, in the fields for the link ID and the link length, the identification numbers of links whose link travel times were obtained and link lengths (the length of the travel) are respectively stored. Incidentally, link IDs and link lengths are information given by the map information storage section 150.

Further, a field for the link travel time is provided with subfields corresponding to clock times obtained by dividing one day from 0 o'clock to 24 o'clock, 288 subfields, for example, corresponding to clock times from 0:00 to 23:55 obtained by dividing one day into time periods of five minutes. Each subfield stores a link travel time obtained by a floating car having run the link (the link with the link ID stored in the link ID field) sometime during the divided five minutes or the average value of the link travel times.

In the case of the VICS DB 130, each subfield of the field for the link travel time stores link travel times, for every five minutes during 0:00 to 23:55, calculated and provided by VICS based on information obtained from a roadside sensor or the like installed at the link.

Incidentally, with respect to the probe DB 120 and VICS DB 130, in a case where link travel time to be stored in the subfield of a certain clock time of the field for the link travel time is lacked (in other words, no link travel time information has been obtained), a value (for example "0") that means missing of data is stored in the subfield.

Figure 3:
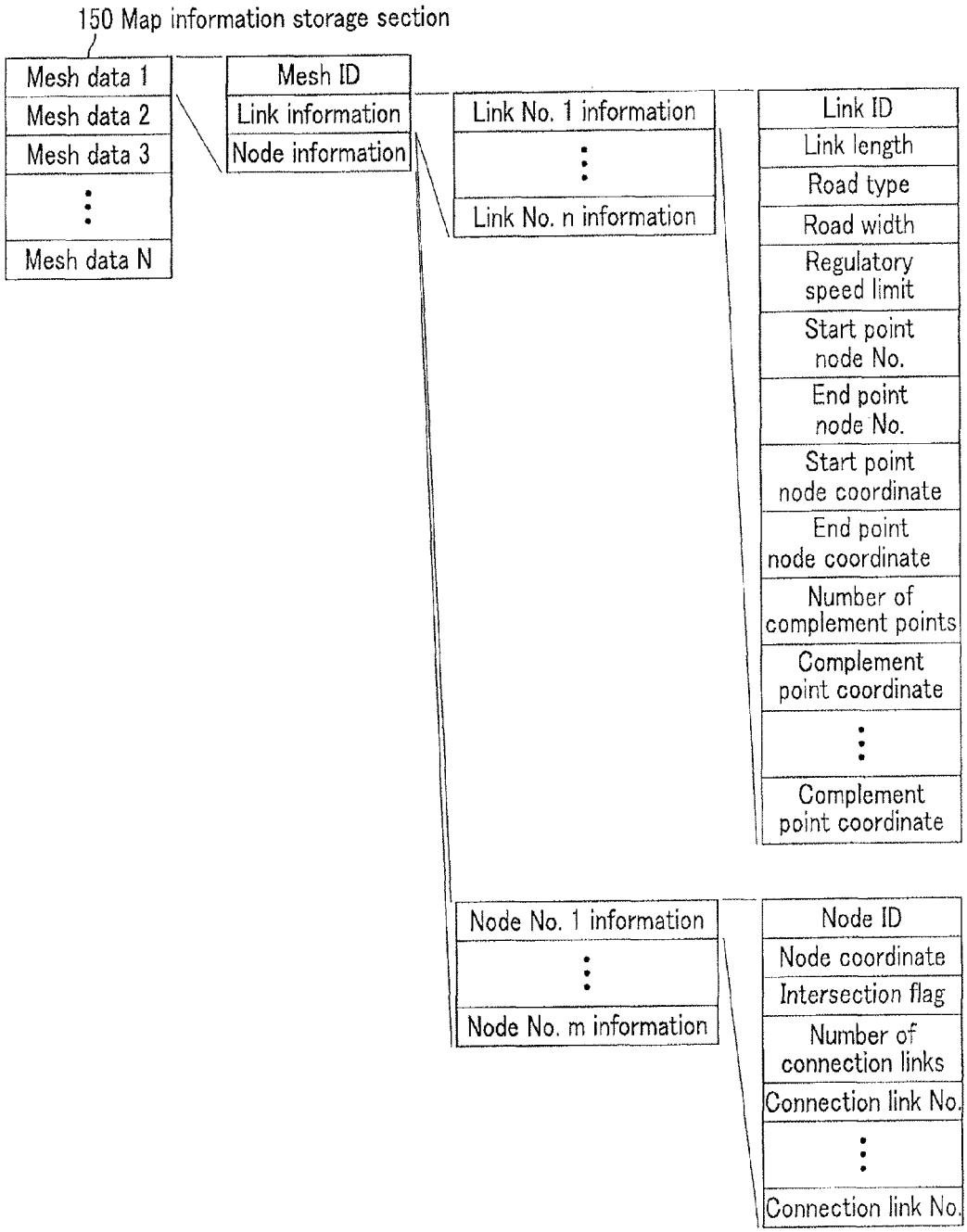
FIG. 3 is a diagram showing an example of a structure of map information stored in a map information storage section.

FIG. 3 is a diagram showing an example of a structure of map information stored in the map information storage section 150. As shown in FIG. 3, the map information is formed by plural mesh data. A mesh refers to a map of a single section of an entire map throughout Japan divided in a mesh form with a certain mesh size, and mesh data refers to various information the map indicates.

In FIG. 3, each mesh data includes a mesh ID, link information, node information, and the like. Herein, a mesh ID is information for identifying a mesh. The link information is information related to a link (also referred to as a road link)

sectioned by an intersection, mesh boundary, or the like. The nord information is information related to a node, such as an intersection, that connects plural road links and sections a road into plural road links.

Though not included in FIG. 3, in addition to the link information and the node information, the mesh data may include information indicating a topographic map of a coast, a mountain, a river, and the like, and information indicating positions of a building, a facility, etc.

In FIG. 3, the link information is formed of information related to all links contained in each mesh, namely, link No. j information (j=1, . . . , n). The respective link No. j information includes a link ID, a link length, a road type (categories of national road, prefectural road, etc.), a road width, a regulatory speed limit, a start point node number, an end point node number, coordinates of a start point node, coordinates of an end point node, a number of complement points, coordinates of complement point, and the like. Incidentally, the start point node number and the end point node number are represented by a node ID described later.

Herein, the coordinates of start point nodes, end point nodes, and complement points are information indicating absolute positions represented by latitudes, longitudes, and the like on a map. Further, a series of complement points represent a curved or crooked link.

The node information is formed of information related to all nodes contained in each mesh, namely, node No. j information (j=1, . . . , m). The respective node No. j information includes a node ID, node coordinates, an intersection flag (a flag indicating that the node is an interaction), a number of connected links (a number of links connected to the node), connected link numbers for the number of connected links (link numbers of links connected to the present node), and the like. Incidentally, a link number is represented by a link ID described above.

FIG. 4 is a diagram showing an example of a record structure of the day type calendar stored in the day-type calendar storage section 140. As shown in FIG. 4, the day type calendar is formed of various fields, such as a date, a day of the week, and a day type.

Herein, the day type is a kind of days (for example, a weekday, a holiday, etc.) which are similar in traffic dynamics and grouped as one category. Day types are not limited to the two categories of a weekday and a holiday, and may be in five categories as follows, for example.

day type 1 (weekday 1) . . . Monday (beginning of weekdays)

day type 2 (weekday 2) . . . Tuesday, Wednesday, and Thursday (middle of weekdays)

day type 3 (weekday 3) . . . Friday (end of weekdays)

day type 4 (holiday 1) . . . Saturday (Saturday)

day type 5 (holiday 2) . . . Sunday and public holiday (Sunday and public holiday)

In the present embodiment, day types will be set to these five categories hereinafter. In the day type field of the day-type calendar storage section 140 in FIG. 4, day types corresponding to respective dates and days of the week are stored, according to these five categories. The statistic DB creation processing section 102 refers to such a day type calendar, sorts probe data and VICS data that are input from the probe DB 120 and the VICS DB 130 into these five categories, and performs statistic processing to create a statistic DB.

Figures 5, 6:
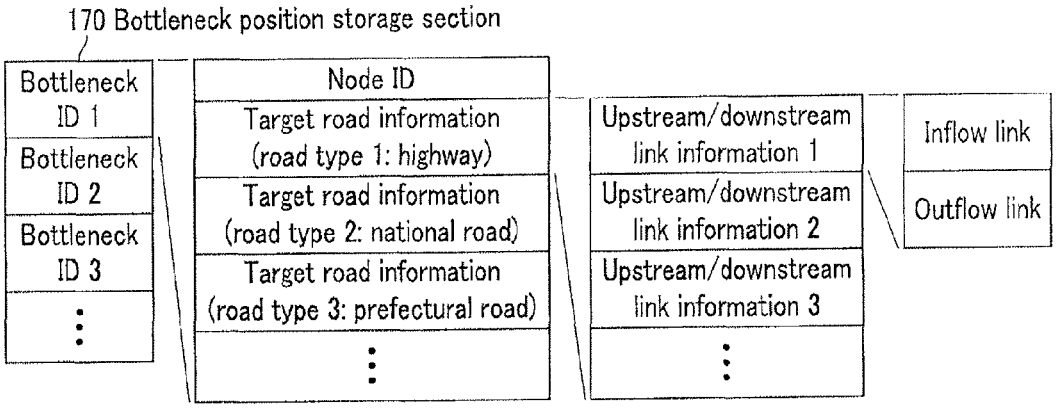
FIG. 5 is a diagram showing an example of a record structure of statistic DB stored in a statistic DB storage section.
FIG. 6 is a diagram showing an example of a structure of bottleneck position information stored in a bottleneck position storage section.

FIG. 5 is a diagram showing an example of a record structure of a statistic DB stored in the statistic DB storage section 160. As shown in FIG. 5, a record of statistic traffic data is formed of fields, such as a day type, a link ID, a link length, a statistic travel time, etc. This structure is similar to the structure of the probe DB 120 (VICS DB 130), however, different in that the fields of the date and the link travel time of the probe DB 120 (VICS DB 130) are replaced respectively by the fields of a day type and a statistic travel time for the statistic DB storage section 160.

Herein, one of the above-described five day types (day type 1 to day type 5) is stored in each day type field. Further, the link ID of one of links stored in the map information storage section 150 is stored in the field of the link ID, and a link length of the link is stored in field of the link length.

Further, similarly to the case of the probe DB 120 (VICS DB 130), a field for the statistic travel time is divided into 288 subfields corresponding to clock times from 0:00 to 23:55. Each subfield stores link travel times having been subjected to statistic processing for the links with the link IDs designated by the link ID field. An example of the statistic processing will be described later.

Incidentally, in the statistic DB storage section 160, in a case where the statistic travel time to be stored in the subfield of a certain clock time of the field for the statistic travel time is lacked, a value (for example "0") that means missing of data is stored in the subfield.

FIG. 6 is a diagram showing an example of a structure of bottleneck position information stored in the bottleneck position storage section 170. In the present embodiment, it will be assumed that a bottleneck position refers to an origin of congestion occurrence, and the origin is a point of an intersection, namely, a node. Accordingly, as shown in FIG. 6, the bottleneck position storage section 170 contains bottleneck information at respective bottleneck positions identified by bottleneck IDs.

Herein, the bottleneck information on the respective bottleneck positions respectively includes a node ID indicating the bottleneck position and upstream/downstream link information for each piece of target road information. Further, the target road information refers to the road type (highway, national road, prefectural road, etc.) of an inflow link that flows in the node of a present bottleneck position.

Further, the upstream/downstream link information is created for each piece of target road information, and is formed of a set of an inflow link and an outflow ink, in other words, a set of the link ID of one link flowing into the node of a present bottleneck position and the link ID of one link flowing out from the node of the present bottleneck position.

Herein, in consideration of the actual traffic status, for a set of the inflow link and the outflow link described above, available combinations of road types are limited, for example, to those that accord with the rules (1) and (2) described below.

(1) When an outflow link of the same road type as the road type of an inflow link is present at a node, a set of the inflow link and the outflow link creates upstream/downstream link information.

(2) When an outflow link of the same road type as the road type of an inflow link is not present at a node, the outflow link with the highest level of the road type is selected from outflow links, and a set of the above-described inflow link and the selected outflow link creates the upstream/downstream link information.

Incidentally, the level of road types referred to herein is assumed to be higher in the order of a highway, a national road (general road), a prefectural road (general road), . . . .

According to this rule, in a case of an intersection between roads of different road types, for example, between a national road and a prefectural road, the upstream/downstream link information between national roads and between prefectural roads is created, while no upstream/downstream link information is created from the prefectural road to the national road nor from the national road to the prefectural road. Accordingly, in this case, one piece of the upstream/downstream link information is created for one inflow link.

On the other hand, in a case of an intersection where roads of the same road type intersect, for example, at a three-road or four-road intersection where national roads intersect, two (in the case of three-road intersection) or three (in the case of four-road intersection) pieces of the upstream/downstream link information are created for one inflow link. Further, at a three-road intersection where a prefectural road merges into a national road (Y-shaped intersection or T-shaped intersection), only one piece of the upstream/downstream link information is created for an inflow link of the national road, while two pieces of the upstream/downstream link are created for the inflow link of the prefectural road unless right turn or left turn is prohibited.

Incidentally, in the bottleneck position storage section 170 in FIG. 6, when a road type designated by target road information is not contained as the road type of an inflow link to the node of a present bottleneck position, target road information of the road type may not be provided, or target road information of the road type may be given with information notifying that no upstream/downstream link information is present.

Further, in the present embodiment, the target road information is applied to a road type (highway, national road, prefectural road, etc.), however, without being limited thereto, may be defined by a road width, a number of lanes, or the like.

FIG. 7 is a diagram showing an example of a record structure of a complementary-reference-link candidate extraction-rule storage section 180. As shown in FIG. 7, each one record in the complementary-reference-link candidate extraction-rule storage section 180 represents an individual and independent extraction rule for extracting a complementary-reference-link candidate, and is formed of fields, such as a rule ID, a target road, extraction conditions, and the like. Further, the field for extraction conditions is formed of subfields, such as a mesh, a road type, a connection relation, a link angle, a distance between midpoints, and the like.

Such extraction rules are used when a reference-link-candidate extraction processing section 106 extracts candidates for the complementary reference link for a complement target link, and are defined as conditions of a spatial position relationship with the complement target link. That is, in the respective extraction rules identified by a rule ID, a target road represents a requirement of the road to which a complementary reference link belongs, and extraction conditions represent requirements to be satisfied by candidates for the complementary reference link as a link.

Herein, a target road can be the same route, a paralleled rode, a surrounding area, or the like. A route refers to a road of a single series of road sections continuous with each other, and such a route is ordinarily and often given with a name such as "route xx", "xx way", "xx street", or the like. Accordingly, the same route refers to a route to which a present complement target link belongs, and a parallel route refers to a route being near the present compliment target link and having approximately the same direction as the route to which the present complement target link belongs.

Further, an integer "N" greater than or equal to zero is stored in a subfield for a mesh of extraction conditions. The character "N" designates a range of meshes for searching complementary reference links, that is, N×N meshes with the own mesh at the center (N is an odd number). For example, in a case of "N=1", only the mesh containing the complement target link is the searching target, and in a case of "N=3", 3×3 meshes (nine meshes) with the mesh containing the complement target link at the center are the search target. Incidentally, in a case of "N=0", meshes of search target are not limited.

In a subfield for the road type, "0" or "1" is stored. Herein, in a case of "1", links of the same road type as the complement target link are targets for searching complementary-reference-link candidates. In a case of "0", complementary-reference-link candidates are searched without a limitation of the road type.

In a subfield for the connection relation, "an integer greater than or equal to 1" is stored. Herein, "an integer greater than or equal to 1" represents a range of a link connection degree for searching complementary reference links. That is, "1" represents a primary connection, which means that links in a direct connection relation with the complement target link is the target for searching complementary-reference-link candidates. Further, "2" represents a quadratic connection, which means that the target for searching is up to the links in a direct connection relation with the primary connection links. Incidentally, "-" means that data is unnecessary due to the nature of the rule.

In a subfield for the link angle, "an integer greater than or equal to zero, and smaller than 90", or "-" is stored. Herein, "an integer greater than or equal to zero, and smaller than 90" refers to an angle intersecting with the complement target link. For example, in a case of "45", links intersecting with the complement target link at an angle smaller than 45 degrees are the target for complementary-reference-link candidates. Herein, in calculating the angle between links, a link is handled as a vector connecting the start point and end point by a straight line. Incidentally, "-" means that data is unnecessary due to the nature of the rule.

In a subfield for the distance between midpoints, "an integer greater than or equal to zero" is stored. Herein, "an integer greater than or equal to zero" means the distance from the midpoint between the start point and end point of the complement target link. For example, "1000" represents that links existing within a range of 1000 m centering around the midpoint of the complement target link are candidates for the complementary-reference-link target. Herein, the position of a complementary reference link is the midpoint between the start point the end point. Incidentally, "-" means that data is unnecessary due to the nature of the rule.

The reference-link-candidate extraction processing section 106 extracts a link/links satisfying all the extraction conditions as described above, as a candidate/candidates for the complementary reference link for each extraction rule. Incidentally, with regard to the complementary-reference-link candidate extraction rules stored in the complementary-reference-link candidate extraction-rule storage section 180, it will be assumed that the smaller the rule ID is, the higher the priority order is.

Figure 8:
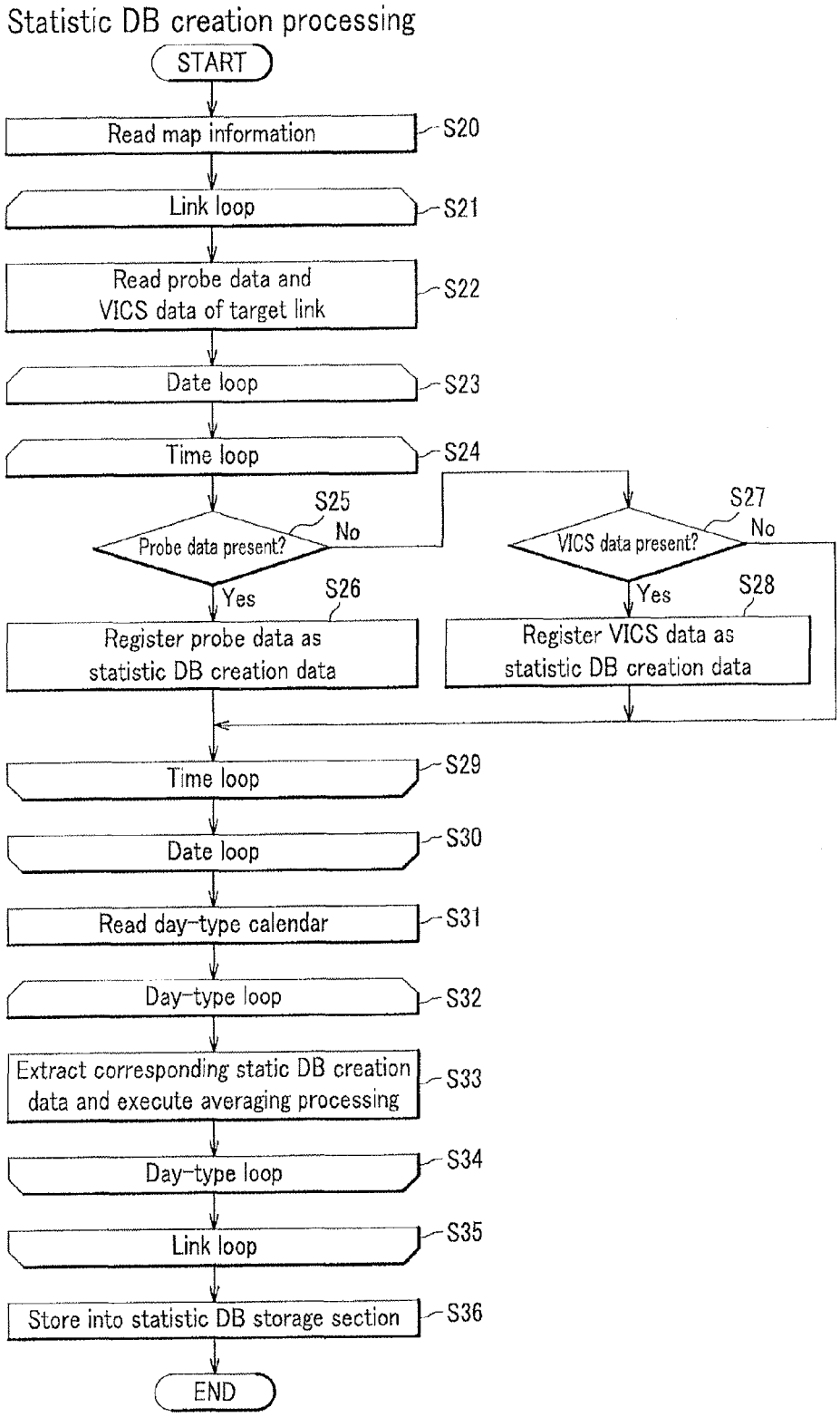
FIG. 8 is a diagram showing an example of a processing flow of statistic DB creating processing.

FIG. 8 is a diagram showing an example of a processing flow of statistic DB creation processing. The CPU of the statistic traffic information generating apparatus 100 executes the statistic DB creation processing shown in FIG. 8, as a processing by the statistic DB creation processing section 102.

The CPU, first, reads the map information stored in the map information storage section 150 (step S20). Then, the CPU repeatedly executes link loop processing (processing from step S21 to step S35) for each piece of link information identified by the link ID of the map information.

The CPU refers to the probe DB 120 and the VICS DB 130 in the link loop processing, and reads probe data and VICS data of a target link for a present link loop (step S22).

Then, the CPU repeatedly executes date loop processing (processing from step S23 to step S30) and time loop processing (from step S24 to step S29) for all dates and clock times (the clock times referred to herein are the respective clock times assigned to the respective subfields of the field for the link travel time) contained in the above-described probe data and VICS data having been read.

In the date loop processing and the time loop processing, the CPU checks whether or not probe data of the link travel time on a target date and at a target clock time of the processing is present (step S25), and if the probe data is present (Yes in step S25), then the CPU registers the probe data as data for creation of a statistic DB (step S26).

If the probe data is not present (No in step S25), the CPU further checks whether or not VICS data of the link travel time on a target date and at a target clock time of the processing is present (step S27), and if the VICS data is present (Yes in step S27), then the CPU registers the VICS data as data for creation of the statistic DB (step S28). Incidentally, if it is determined in step S27 that the VICS data is not present (No in step S27), then execution in step S28 is skipped.

When the above-described date loop and the time loop are terminated (steps S29 and S30), the CPU refers to the day-type calendar storage section 140 and reads the day type calendar (step S31).

Then, the CPU repeatedly executes day type loop processing (from step S3 to step S34) for all day types contained in the above-described day type calendar. The CPU extracts statistic DB creating data of a corresponding day type from the statistic DB creating data registered as described above, and executes averaging processing of the statistic DB creating data (step S33).

Incidentally, although this averaging processing is performed for each subfield (each clock time during 0 O'clock to 24 O'clock), if no statistic DB creating data is registered for the corresponding day type or the clock time, a value ("0" for example) representing missing is set.

Then, when the CPU terminated the day type loop and link loop processing (steps S34, S35), the CPU stores the average values (the average values of link travel times at the respective clock times) of the statistic DB creating data obtained by the above-described averaging processing into the statistic DB storage section 160 (step S36). Through the above-described processing, statistic DB of the statistic DB storage section 160 is created.

Figure 9:
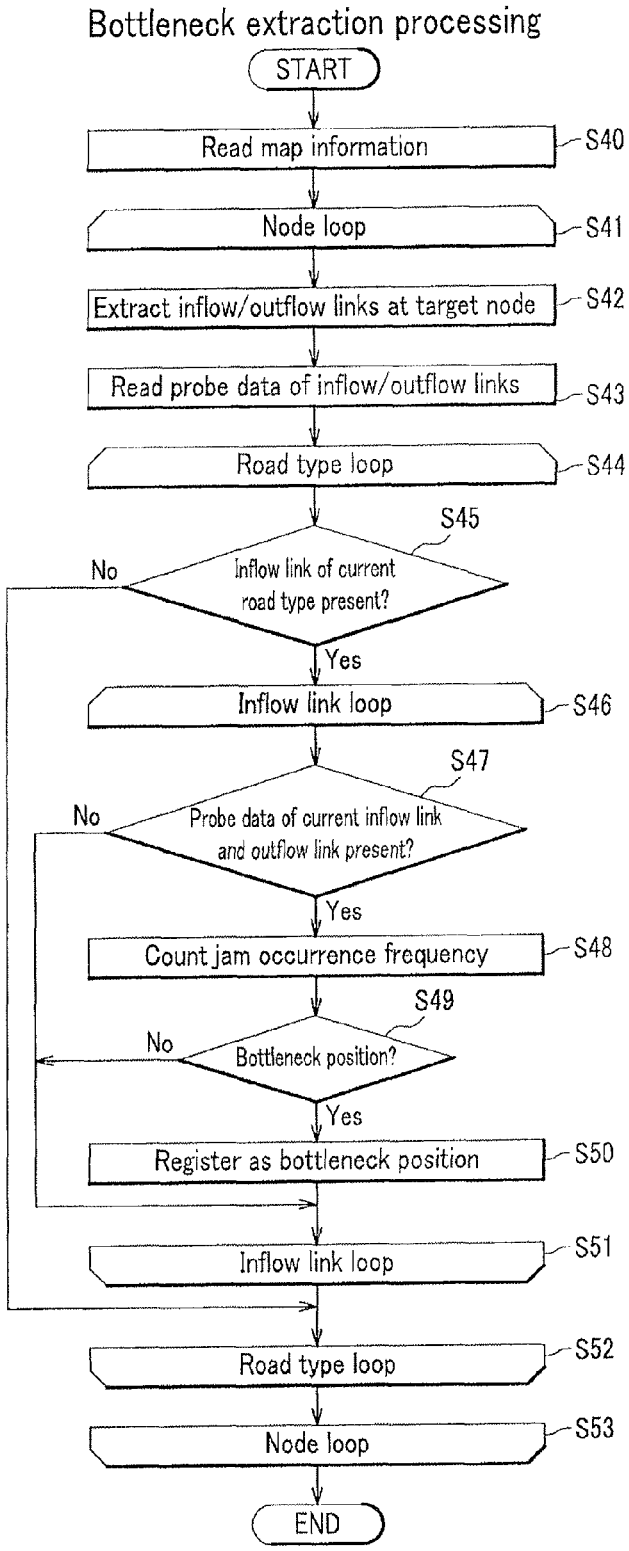
FIG. 9 is a diagram showing an example of a processing flow of bottleneck extraction processing.

FIG. 9 is a diagram showing an example of a processing flow of bottleneck extraction processing. The CPU of the statistic traffic information generating apparatus 100 executes the bottleneck extraction processing shown in FIG. 9 as a processing by the bottleneck extraction processing section 104.

The CPU, first, reads map information stored in the map information storage section 150 (step S40). Then, the CPU repeatedly executes node loop processing (processing from step S41 to step S53) for each piece of node information identified by a node ID of the map information.

The CPU extracts inflow and outflow links to and from the target node of a present node loop in the node loop processing (step S42), and further reads the probe data of the inflow and outflow links, referring to the probe DB 120 (step S43). Herein, inflow and outflow links collectively refer to an inflow link/links to a certain node and an outflow link/links from the node.

Incidentally, whether a connection link to the present node is an inflow link or outflow link is determined such that, referring to the connection link number in the node information on the node, and further referring to link information designated by the connection link number, the determination is made depending on whether a node number of the node is the node number at the start-point or the node number at the end point of the link information.

Further, in the extraction processing in step S42, links which are positioned at the same road section common to an inflow link and outflow link, namely, links in connection relation of U-turn are handled to be out of target for extraction. This elimination processing can be attained, for example, by eliminating the combination in which the start node and the end node of an inflow link agree respectively with the end node and start node of an outflow link.

Then, the CPU repeatedly executes road type loop processing (from step S44 to step S52) for each road type contained in the map information. Then, in a present road type loop processing, the CPU checks whether or not an inflow link of the road type being the target is present (step S45). As a result of the checking, if there is no inflow link of this road type (No in step S45), then, the road type loop processing is terminated for this road type.

On the other hand, if there is an inflow link of the road type of the target in the loop in step S45 (Yes in step S45), the CPU repeatedly executes inflow link loop processing (from step S46 to step S51). Then, the CPU obtains an outflow link to the inflow link as the loop target in a present inflow link loop processing, and checks whether or not probe data is present for the inflow link and the outflow link (step S47). As a result of the checking, if no probe data is present for the inflow link and the outflow link (No in step S47), then the inflow link loop is terminated for the present inflow link.

If probe data is present for the inflow link and the outflow link in step S47 (Yes in step S47), then, the CPU counts the frequency of congestion occurrence, based on the probe data for the inflow link and the outflow link (step S48: a method for counting the occurrence frequency will be described later).

Incidentally, the determination of presence or absence of the probe data in step S47 is performed on respective outflow links when plural outflow links are present, and further, if at least one data of link travel time is present in the subfields corresponding to the clock times during 0 O'clock to 24 O'clock of the field of link travel time of the probe data record, it is determined that the probe data is present.

Then, the CPU determines a bottleneck position (step S49: a method for determination will be described later), based on the congestion occurrence frequency of the inflow link and the congestion occurrence frequency of the outflow link. If determined as the bottleneck position (Yes in step S49), then the CPU registers a set of the inflow link and the outflow link in the bottleneck position storage section 170 (step S50) as a bottleneck position, and terminates the inflow link loop for the present inflow link.

If determined not to be the bottleneck position in step S49 (No in step S49), the CPU skips execution of step S50 and terminates the inflow link loop for the present inflow link.

When the CPU terminates the above-described inflow link loop processing (processing from step S46 to step S51), then, terminates the road type loop processing (processing from step S44 to step S52), further, terminates the node loop processing (processing from step S41 to step S53), and terminates the bottleneck extraction processing.

Now, a method of counting the congestion occurrence frequency and a method of determination of a bottleneck position in step S48 and step S49 will be described.

In order to count the congestion occurrence frequency, the CPU obtains link travel times $T_{in}$ and $T_{out}$ on the same date and at the same clock time for a set of one inflow link and one outflow link from the probe data read-in in step S43. Further, the CPU likewise obtains the link lengths $L_{in}$ and $L_{out}$ for the present inflow link and the outflow link.

Then, if the condition represented by the following Expression (1-1) is satisfied, the CPU determines that the present inflow link is in a congestion, and if the condition represented by Expression (1-2) is satisfied, the CPU determines that the present outflow link is in a congestion.

$$3.6\times(L_{in}/T_{in})<20 \text{ [km/h]} \quad \text{Expression (1-1)}$$

$$3.6\times(L_{out}/T_{out})<20 \text{ [km/h]} \quad \text{Expression (1-2)}$$

That is, when a vehicle runs on the inflow link or the outflow link at an average speed lower than or equal to 20 km/h, the CPU determines that the vehicle is in a congestion. Incidentally, the threshold for the determination of a congestion is not limited to 20 km/h, and may be another value. Further, the threshold may be of different values depending on the road type of a link.

The CPU performs this determination processing on each inflow link and outflow link for all dates and clock times, obtains the number of times $C_{jam}$ when the inflow link is in a congestion and the outflow link is not in a congestion out of the total number of determination processing times $C_{all}$. If the following Expression (2) is satisfied, the CPU determines that a node where a present inflow link flows in is a bottleneck position.

$$C_{jam}/C_{all}>0.5 \quad \text{Expression (2)}$$

Incidentally, when plural outflow inks are present for a single inflow link, the determination of a bottleneck position according to Expression (2) is performed on all the plural outflow links, and when at least one outflow link satisfying Expression (2) is present, the node where the inflow link flows in is determined to be a bottleneck position.

Incidentally, although the threshold for determination of a bottleneck position is set to 0.5 in Expression (2), the threshold may be another value. Further, although determination of a congestion and determination of a bottleneck position are performed for all time zones herein, the determinations may be performed only for rush time zones such as morning end evening.

Figure 10:
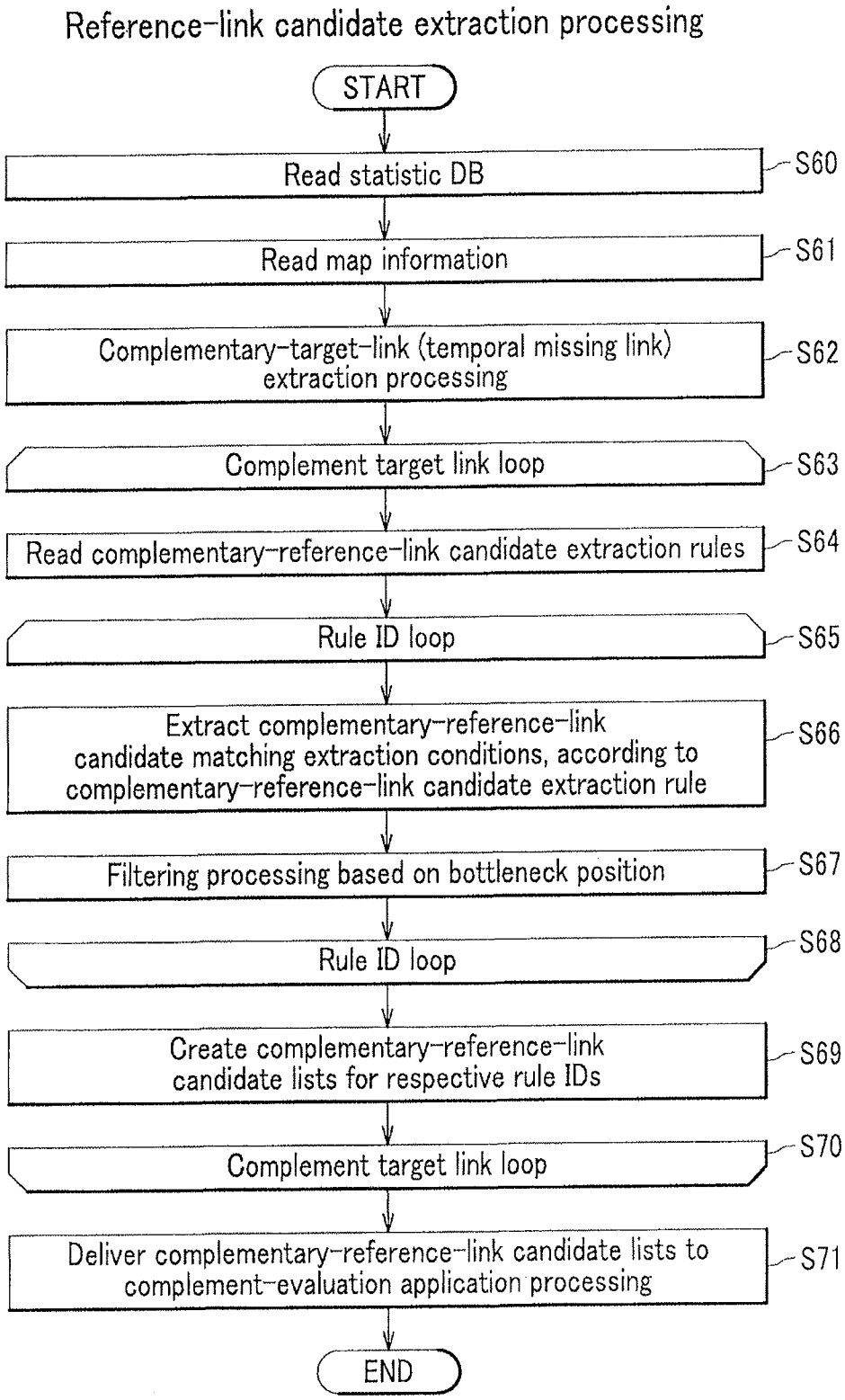
FIG. 10 is a diagram showing an example of a processing flow of reference-link candidate extraction processing.

FIG. 10 is a diagram showing an example of a processing flow of reference-link candidate extraction processing. The CPU of the statistic traffic information generating apparatus 100 executes reference-link candidate extraction processing shown in FIG. 10 as a processing by the reference-link-candidate extraction processing section 106.

The CPU, first, reads the statistic DB stored in the statistic DB storage section 160 (step S60), and further reads the map information stored in the map information storage section 150 (step S61).

Then, the CPU extracts complement target links, namely, temporal missing links from the statistic DB (step S62). Herein, referring to the statistic DB having been read, the CPU checks subfields corresponding to the clock times during 0 O'clock to 24 O'clock of the statistic travel time of a record for each day type and link ID, and extracts links to which at least one value ("0" for example) representing a state of being unknown or missing is set as temporal missing links, namely, complement target links. Then, the link IDs of the extracted complement target links are stored as a complement target link list.

Then, referring to the complement target link list, the CPU takes out the link IDs from the list one by one, and repeatedly executes complement target link loop processing (the processing from step S63 to step S70) on the links designated by the link IDs, namely, the complement target links.

In the complement target link loop processing, the CPU reads complementary-reference-link candidate extraction rules stored in the complementary-reference-link candidate extraction-rule storage section 180 (step S64), and repeatedly executes rule ID loop processing (the processing from step S65 to step S68) for respective extraction rules designated by the rule IDs of the complementary-reference-link candidate extraction rules having been read.

In the rule ID loop processing, according to the extraction rule which is designated by a present rule ID, for extraction of a complementary-reference-link candidate, the CPU refers to the map information storage section 150, and extracts a complementary-reference-link candidate matching the extraction conditions (step S66). In this step S66, the CPU executes the following processing from [S1-1] to [S1-4].

[S1-1]: First, the CPU refers to the subfield for the mesh out of extraction conditions of a present rule ID, and takes out an area for searching a complementary-reference-link candidate. That is, the CPU takes out one mesh containing the complement target link in a case where the subfield for the mesh is "1", and takes out 3×3 in a case where the subfield for the mesh is "3", namely, nine meshes, having the mesh containing the complement target link at the center. Herein, in a case where the subfield for the mesh is "0", all meshes are taken as targets because of no mesh limitation.

[S1-2]: Next, referring to the subfield for distance between midpoints of the above-described extraction conditions, the CPU performs processing of narrowing down complementary-reference-link candidates from the links present in the meshes taken out in [S1-1]. First, the CPU calculates a midpoint of the line connecting the start point and the end point of the complement target link; calculates the midpoints of respective lines connecting the start points and the end points of all links which are present in the meshes taken out in [S1-1]; and extracts only links whose midpoints have a distance smaller than the distance stored in the subfield for midpoint distance of the extraction conditions, as complementary-reference-link candidates. Herein, in a case where the subfield for the mesh is "0", all meshes are targets in [S1-1], and it is necessary to obtain midpoints of the links of all the meshes. Therefore, only in this case, surrounding meshes centering the mesh containing the complement target link are added one after another to expand the surrounding area, while checking the distance of the midpoint of a link in a newly added mesh one after another. A complementary-reference-link candidate is extracted within a range of the surrounding meshes at a moment when a link, which has a distance longer than the distance stored in the subfield for the midpoint distance of the extraction conditions, has been found. Incidentally, in a case where the subfield for the midpoint distance of the extraction conditions is "-", all the links present in the meshes taken out in [S1-1] are extracted as the complementary-reference-link candidates.

[S1-3]: Then, the CPU executes processing of narrowing out complementary-reference-link candidates, based on agreement with respect to the road type between a complementary-reference-link candidate extracted in [S1-2] and the complement target link. First, the CPU refers to the subfield for the road type of the extraction conditions, and in a case of "1", extracts only complementary-reference-link candidates whose road type agrees with that of the complement target link. On the other hand, in a case where the subfield for the road type of the extraction conditions is "0", the complementary-reference-link candidates extracted in [S1-2] are maintained as they are as complementary-reference-link candidates, because there is no limitation of the road type.

[S1-4]: Then, the CPU executes processing of narrowing down complementary-reference-link candidates, based on the determination of connection between the complement target link and a complementary-reference-link candidate extracted in [S1-3]. First, referring to the link connection degree stored in the subfield for the connection relation of the extraction conditions, and the node numbers of start points and the node numbers of end points in the map information stored in the map information storage section 150, the CPU identifies links from the complement target link to the links with the connection degree, by going back upstream and downstream. Then, the CPU extracts only links which agree with the complementary-reference-link candidates extracted in [S1-3] out of the identified links, and reassigns the extracted links to the complementary-reference-link candidates. Herein, in a case where the subfield for the connection relation of the extraction conditions is "-", the complementary-reference-link candidates extracted in [S1-3] are maintained as they are as the complementary-reference-link candidates.

[S1-5]: Then, the CPU executes narrowing down complementary-reference-link candidates, based on the determination of parallelism between the complement target link and the complementary-reference-link candidates extracted in [S1-4]. First, based on the map information stored in the map information storage section 150, the CPU reads the node coordinates of the node of the start point and the node of the end point of the complement target link, and the node coordinates of the nodes of the start points and the nodes of the end points of the respective complementary-reference-link candidates.

Herein, a vector from the start point toward the end point of the complement target link will be represented by "a", and a vector from the start point toward the end point of a certain complementary-reference-link candidate will be represented by "b". Further, representing the angle stored in the subfield for link angle of the extraction conditions by θ, the CPU adopts a link satisfying the following Expression (3) as a complementary-target-link candidate.

$$\theta > \arccos(a \cdot b / |a| \cdot |b|) \qquad \text{Expression (3)}$$

In step S66, the complementary-reference-link candidates extracted by the above-described processing are output as information on complementary-reference-link candidates corresponding to the present rule ID.

Incidentally, such extracted complementary-reference-link candidates can be a temporal missing link. In this case, there is a possibility that the statistic travel time information on such a link cannot be used for compliment. Therefore, auxiliary processing, not shown, is added herein, and with regard to the complementary-reference-link candidates extracted in step S66, the subfields corresponding to the respective clock times during 0 O'clock to 24 O'clock in the field for the statistic travel time are checked, by further referring to the statistic DB. Then, those, for which significant data of link travel times are stored in more than or equal to 80% of the subfields of the field for the statistic travel time, are selected as the complementary-reference-link candidates.

Incidentally, in a case where the subfields of the field for the statistic travel time correspond to the clock times for every five minutes during 0 O'clock to 24 O'clock, there are 288 subfields in total, and 80% thereof is 230 subfields. That is, if there are 230 statistic travel times out of total 288 statistic travel times, the present link can be a complementary-reference-link candidate. The value of 80% used herein as the threshold value may be another value.

Then, the CPU performs filtering processing on such extracted complementary-reference-link candidates, based on bottleneck positions (step S57). In the filtering processing, the CPU executes the following processing [S2-1] to [S2-4].

[S2-1]: The CPU, first, refers to the bottleneck position storage section 170, and determines whether or not a present complement target link corresponds to an inflow link or outflow link at a node of a bottleneck position.

[S2-2]: Then, as a result of the determination, if the present complement target link corresponds to the inflow link or the outflow link at the node of the bottleneck position, then the CPU also determines whether or not a complementary-reference-link candidate corresponds to an inflow link or outflow link at a node of a bottleneck position. If the position relation (an inflow link or outflow link) of the complement target link and the position relation of the complementary-reference-link candidate to the node of the respective corresponding bottleneck position agree with each other, then the complementary-reference-link candidate is adopted as it is as the complementary-reference-link candidate. If the position relations do not agree with each other, then the complementary-reference-link candidate is eliminated from the complementary-reference-candidates.

[S2-3]: However, when the complement target link corresponds to an inflow link or outflow link at the bottleneck position, and the rule ID of the present rule ID loop is "1" (the same route), the following processing is performed instead of the processing in "S2-2". That is, when the complement target link corresponds to an inflow link at the bottleneck position, a complementary-reference-link candidate corresponding to an upstream link of the inflow link is adopted as it is as a complementary-reference-link candidate, however, a complementary-reference-link candidate corresponding to an outflow link for the inflow link or a downstream link of this outflow link is eliminated from the complementary-reference-link candidates. Further, when the complement target link corresponding to an outflow link at the bottleneck position, a complementary-reference-link candidate corresponding to an downstream link of the outflow link is adopted as it is as a complementary-reference-link candidate, however, a complementary-reference-link candidate corresponding to an inflow link for the outflow link or an upstream link of this inflow link is eliminated from complementary-reference-link candidates.

[S2-4]: Further, in the determination in [S2-1], in a case where the present complement target link does not corresponds to an inflow link nor outflow link at the bottleneck position, the CPU also determines whether or not a complementary-reference-link candidate corresponds to an inflow link or outflow link at the bottleneck position. A complementary-reference-link candidate that corresponds to neither an inflow link nor outflow link at the node at the bottleneck position, and a complementary-reference-link candidate that corresponds to an outflow link from the node at the bottleneck position are adopted as it is as a complementary-reference-link candidate. Further, a complementary-reference-link candidate corresponding to an inflow link at the bottleneck position is eliminated from complementary-reference-candidates.

Incidentally, the above-described processing can also be summarized as follows. That is, in a case where the complement target link corresponds to an inflow link of the node at the bottleneck position, the CPU eliminates links other than a link that is an inflow link of the node at the bottleneck position or an upstream link of this inflow link from complementary-reference-candidates. In a case where the complement target link does not correspond to an inflow link of the node at the bottleneck position, the CPU eliminates a link corresponding to an inflow link of the node at the bottleneck position from complementary-reference-link candidates.

Herein, the purpose of performing the above-described filtering processing on complementary-reference-link candidates is to eliminate an inflow link and an outflow link at a bottleneck position that is not necessarily considered to be appropriate as a complementary reference link, from complementary-reference-link candidates, while considering the fitting status of the complement target link at the bottleneck position.

Through the above-described processing, when the rule ID loop processing is terminated (step S68), then the CPU creates complementary-reference-link candidates lists for the respective rule IDs (step S69). In these complementary-reference-link candidates lists, complementary-reference-link candidates for the respective rule IDs are listed corresponded to all rule IDs.

Through the above-described processing, when the complement target link loop is terminated (step S70), the complementary-reference-link candidates lists which are related to the respective rule IDs are created for the respective complement target links, by being corresponded to respective complement target links. Then, the CPU delivers the created complementary-reference-link candidate lists for the respective complement target links and for the respective rule IDs, to complement-evaluation applying processing (step S71), and terminates the reference-link-candidate extraction processing.

FIGS. 11A and 11B show aspects where complementary-reference-link candidates are extracted in the reference-link-candidate extraction processing in FIG. 10 and subjected to filtering. In FIG. 11A, the link shown by a dashed arrow is a complement target link.

First, in complementary-reference-link candidate extraction processing (refer to FIG. 10: step S66) according to the complementary-reference-link candidate extraction rule, link #3 and link #4 are extracted as the complementary-reference-link candidates, according to the rule (refer to FIG. 7) of rule ID=1 (the same route). Further, according to the rule (refer to FIG. 7) of rule ID=2 (parallel route), link #1 and link #2 are extracted as the complementary-reference-link candidates.

Herein, it is assumed that the bottleneck position storage section 170 stores information on bottleneck positions as follows.

That is, information on an upstream link and a downstream link at bottleneck ID=1 is assumed that (inflow link, outflow link)=(complement target link, link #4), and information on an upstream link and a downstream link at bottleneck ID=2 is assumed that (inflow link, outflow link)=(link #1, link #2).

Incidentally, in FIG. 11B, the nodes shown by hatched thick circles represent these bottlenecks.

When the filtering processing (refer to FIG. 10: step S67) based on bottleneck positions is applied to these data, first, it is determined by the above-described processing [S2-1] that the complement target link corresponds to an inflow link at a bottleneck position.

Then, for rule ID=1 (the same route), link #3 is maintained to be a complementary-reference-link candidate by the processing [S2-3] because link #3 is an upstream link of the complement target link. On the other hand, link #4 is eliminated from complementary-reference-link candidates by the processing [S2-3] because link #4 is an outflow link with respect to the complement target link.

Further, for rule ID=2 (parallel route), since link #1 is an inflow link to a bottleneck position with the same position relation as the complement target link, link #1 is maintained to be a complementary-reference-link candidate by processing [S2-2]. On the other hand, since link #2 is an outflow link from a bottleneck position with a position relation different from the complement target link, link #2 is eliminated from complementary-reference link candidates by processing [S2-2].

Through the above-described processing, complementary-reference-link candidates after the filtering processing are link #3 for rule ID=1, and link #1 for rule ID=2. Incidentally, in FIG. 11B, a mark "x" given to link #2 and link #4 represents links eliminated from complementary-reference-link candidates.

Figure 12:
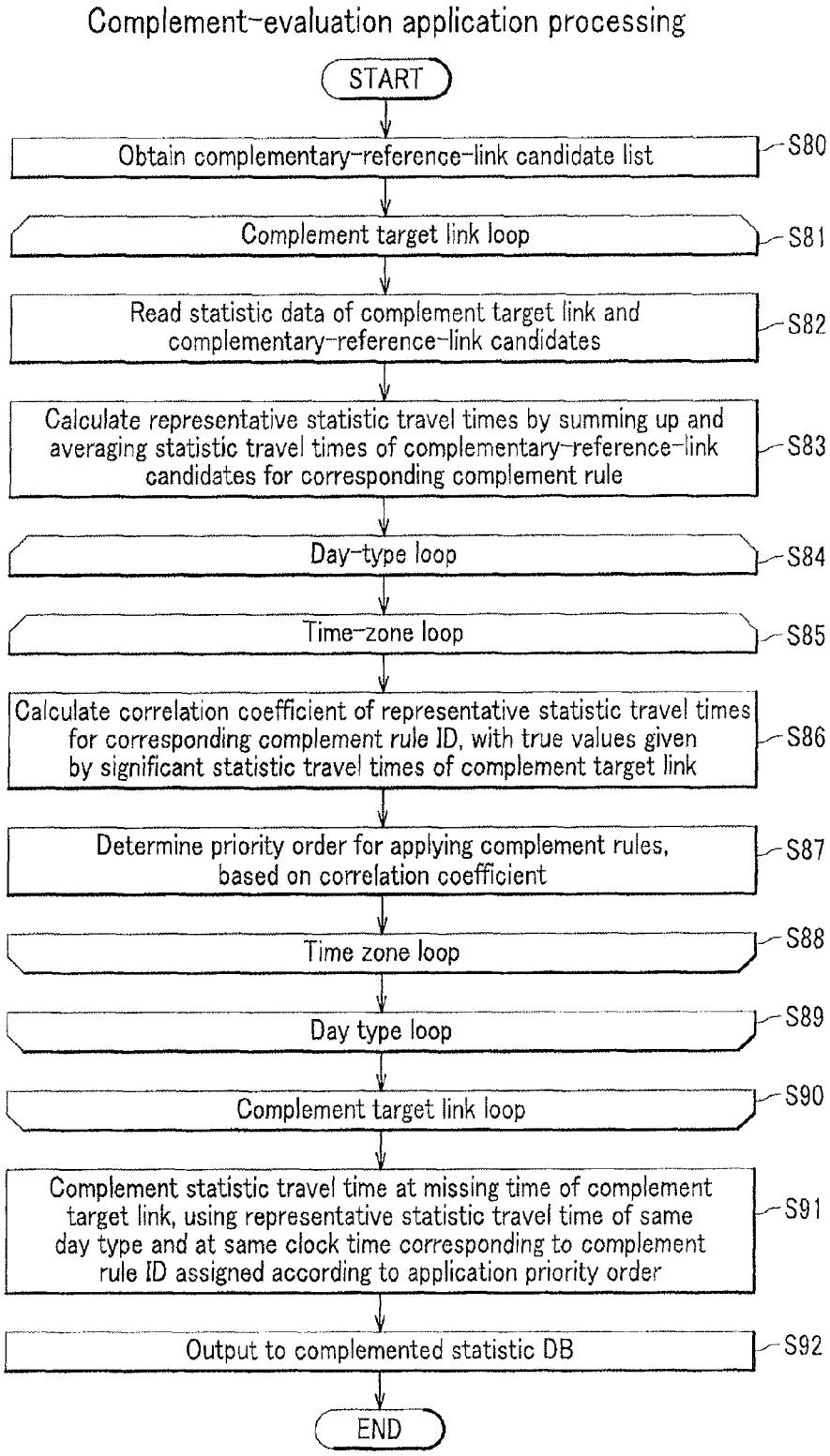
FIG. 12 is a diagram showing an example of a processing flow of complement-evaluation applying processing.
Figure 14A:
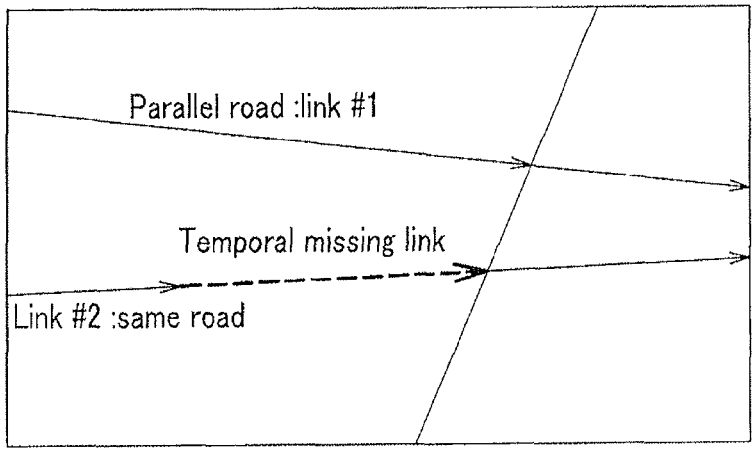
FIG. 14 is a diagram showing an example of a temporal-missing link, and a parallel route and the same route in a case of complementing the traffic information of the temporal-missing link.
Figure 14B:
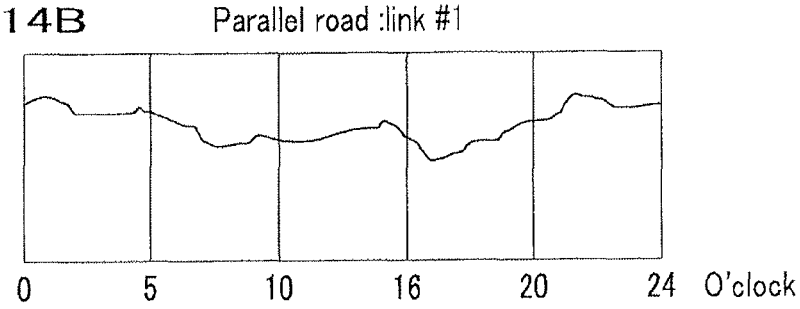
Figure 14C:
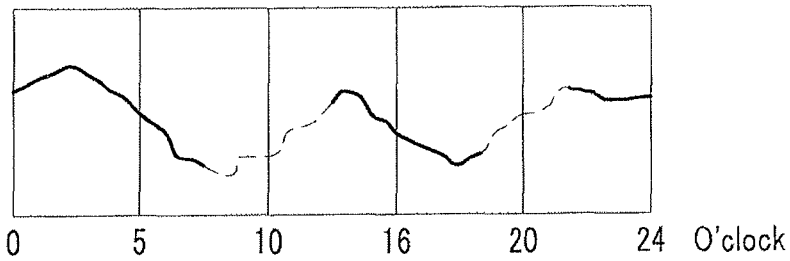
Figure 14D:
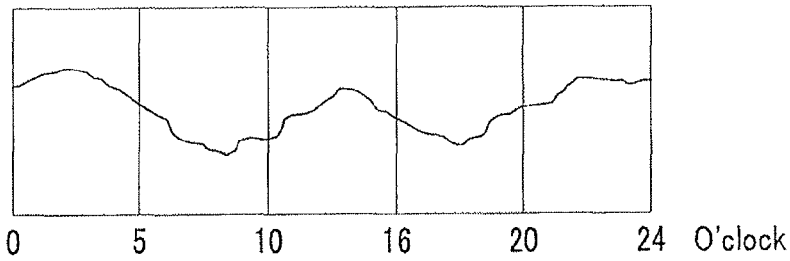

FIG. 12 is a diagram showing an example of a processing flow of complement-evaluation application processing. The CPU of the statistic traffic information generating apparatus 100 executes the complement-evaluation application processing shown in FIG. 12 as a processing by the complement-evaluation application processing section 108.

The CPU, first, obtains the complementary-reference-link candidates lists delivered by the reference-link-candidate extraction processing section 106 (step S80). Because these complementary-reference-link candidate lists are created corresponded to the complement target links, the CPU repeatedly executes the complement target link loop processing (from step S81 to step S90) on the complement target links.

Then, referring to the statistic DB storage section 160 in the complement target link loop, the CPU reads the statistic data of a complement target link of a present target, and corresponding complementary-reference-link candidates (step S82). Then, the CPU sums up and averages the statistic travel times of the complementary-reference-link candidates to calculate representative statistic travel times for each complement rule ID (step S83).

This processing of calculating representative statistic travel times is a processing that averages statistic travel times for each same day type and for each same clock time in a case where plural complementary-reference-link candidates are present for each complement rule. Representative statistic travel time is obtained by the following calculating expressions.

Herein, in respective cases where rule ID=1, 2, and 3, the statistic travel times of respective complementary-reference-link candidates for the day types I (I=1 to 5) and clock times t will be expressed as follows.

For a case where rule ID=1:

$$T_{rule1_1}(I,t), T_{rule1_2}(I,t), \ldots, T_{rule1_N1}(I,t)$$

For a case where rule ID=2:

$$T_{rule2_1}(I,t), T_{rule2_2}(I,t), \ldots, T_{rule2_N2}(I,t)$$

For a case where rule ID=3:

$$T_{rule3_1}(I,t), T_{rule3_2}(I,t), \ldots, T_{rule3_N3}(I,t)$$

Incidentally, clock times t are those for every five minutes, and represent t=00:00, 00:05, . . . , 23:55. Hereinafter, clock times t represent the same unless described otherwise.

Further, N1, N2, and N3 represent the number of complement target link candidates corresponding to the respective rule IDs. However, a complement target link candidate, for which no data of statistic travel time is present at a certain clock time t, is not counted in the number.

Herein, for the respective rule IDs, namely, rule ID=1, 2, and 3, the representative statistic travel times of $T_{rule1}(I, t)$, $T_{rule2}(I, t)$, and $T_{rule3}(I, t)$ will be represented by the following Expression (4).

$$T_{rule1}(I, t) = (1/N1) \cdot \sum_{i=1}^{N1} (T_{rule1 \ldots i}(I, t))$$

$$T_{rule2}(I, t) = (1/N2) \cdot \sum_{j=1}^{N2} (T_{rule2 \ldots j}(I, t))$$

$$T_{rule3}(I, t) = (1/N3) \cdot \sum_{k=1}^{N3} (T_{rule3 \ldots k}(I, t))$$

Expression (4)

Then, the CPU repeatedly executes day type loop processing (the processing from step S84 to step S89) and time zone loop processing (the processing from step S85 to step S89), for the day types of day type=1 to 5.

Herein, time zones refer to the following five divided time zones.

before dawn (00:00-05:00)
morning (05:00-10:00)
daytime (10:00-16:00)
evening (16:00-20:00)
night (20:00-24:00)

In the day type loop and the time zone loop, the CPU calculates a correlation coefficient of the representative statistic travel times for each complement rule ID to true values given by significant statistic data (in other words, statistic travel times which are not unknown nor missing), which belongs to the day type and the target time zone of a present loop target, of a corresponding complement target link. (step S86).

Herein, if the representative statistic travel times for the respective rule IDs $T_{rule1}(I, t)$, $T_{rule2}(I, t)$, and $T_{rule3}(I, t)$ are represented by abbreviation as $T_{rule}(I, t)$ and the correlation coefficients in a time zone $\tau$ for the respective IDs $R_{rule1}(I, \tau)$, $R_{rule2}(I, \tau)$ and $R_{rule3}(I, \tau)$ are represented by abbreviation as $R_{rule}(I, \tau)$, then the correlation coefficient $R_{rule}(I, \tau)$ is calculated by the following Expression (5).

Herein, "t" represent clock times in the respective time zones, and for example, when the time zone is morning, the clock times t are t=05:00, 05:05, . . . , 09:55.

$$R_{rule}(I, \tau) = \frac{\sum_t (T_{rule}(I, t) - \overline{T}_{rule}(I)) \cdot (T_{target}(I, t) - \overline{T}_{target}(I))}{\sqrt{\sum_t (T_{rule}(I, t) - \overline{T}_{rule}(I))^2} \cdot \sqrt{\sum_t (T_{target}(I, t) - \overline{T}_{target}(I))^2}}$$

Expression (5)

Herein, for a clock time "t" when $T_{target}(I, t)$ is unknown or missing, this $T_{target}(I, t)$ is eliminated in calculation.

Further, in Expression (4), the bars on $T_{rule}(I)$ and $T_{target}(I)$ indicate that the respective values are temporal average values in a target time zone.

Further, "$\tau$" of $R_{rule}(I, \tau)$ is a symbol identifying a time zone.

Then, the CPU determines a priority order for applying the complement rules, based on the correlation coefficients calculated in step S86 for the respective rule IDs, the day types, and the time zones (step S87). That is, the CPU compares the correlation coefficients, which are calculated for the respective day types and the time zones, for the respective rule IDs, and determines the priority order for applying the complement rules in the order of higher correlation coefficient.

In such a manner, at the time of termination of the time zone loop, the day type loop, and the complement target link loop (step S88, step S89, and step S90), the representative statistic travel times for the respective rule IDs, the day types and the clock times t, and the priority orders for applying complement rules for the respective day types and the time zones were obtained, for each complement target link.

In this situation, the CPU complements the statistic travel time at a missing clock time of a complement target link, using the representative statistic travel time of the same day type and the same time clock, corresponding to a complement rule ID determined according to the priority order for applying complement rules (step S91).

In other words, a missing statistic travel time of a complement target link is complemented by a representative statistic travel time obtained according to a complement rule for the same day type and the same time zone as the complement target, and with the first priority. When the representative statistic travel time according to the complement rule with the first priority is missing, the compliment is made by a representative statistic travel time according to the complement rule with the second priority. Likewise, in the following, when a representative statistic travel time according to the complement rule with a high priority is missing, the complement is made by a representative statistic travel time according to a complement rule with the highest priority except for the complement rule with above-described high priority.

Upon complement of missing data in the statistic DB in such a manner, the CPU outputs the statistic data of the complemented statistic DB to the complemented statistic DB 200 (step S92), and terminates the complement-evaluation applying processing, shown in FIG. 12.

FIG. 13 is a diagram showing an example of a table of priority orders for applying complement rules, for the respective time zones. Such a table is created for each complement target link and day type. Incidentally, in FIG. 13, the smaller the value is, the higher the priority is. For example, FIG. 13 shows that, in the early time zone before dawn, the complement rule with complement rule ID:1 has the highest priority, and in the morning time zone, the complement rule with complement rule ID:2 has the highest priority.

In such a manner, according to the complement-evaluation applying processing in the present embodiment, priority orders for applying complement rules can be determined for the respective time zones, based on correlation coefficients of the respective time zones. The correlation coefficients are obtained from the statistic data (statistic travel time) of a complement target link and the representative statistic data (representative statistic travel times) obtained according to the respective complement rules. Then, the missing data of the complement target link is complemented by the representative statistic data that is obtained according to the complement rule with the highest priority, namely, by the representative statistic data with the highest degree of correlation (correlation coefficient).

That is, in the present embodiment, complement target data (missing data) is complemented based on representative statistic data with a higher degree of correlation, for the respective time zones. In other words, in complementing complement target data, the complement rules are applied being switched dynamically. Consequently, the accuracy of complemented data is improved.

Although, in the foregoing embodiment, correlation coefficients are used as an evaluation index for determination of a priority order for applying complement rules, relative errors between the statistic data (statistic travel times) of a complement target link and the representative statistic data (representative statistic travel times) may be employed as the evaluation index.

Incidentally, the relative errors $E_{rule}$ (I, τ) in the respective time zones are calculated by the following Expression (6).

$$E_{rule}(I, \tau) = \frac{1}{N_\tau} \sum_t \left\{ \frac{(T_{rule}(I, t) - T_{target}(I, t))}{T_{target}(I, t)} \right\} \quad \text{Expression 6}$$

Herein, "t" is a clock time in the respective time zones, and in the time zone of morning, for example, "t" are t=05:00, 05:05, . . . , 09:55. Further, "τ" is a symbol identifying the respective time zones.

For a clock time "t" when $T_{target}$(I, t) is unknown or missing, $T_{target}$(I, t) is eliminated in calculation. Accordingly, $N_\tau$ is the number of significant data in a time zone "τ".

Further, the relative error $E_{rule}$(I, τ) is abbreviation of the relative errors $E_{rule1}$(I, τ), $E_{rule2}$(I, τ), and $E_{rule3}$(I, τ) in the respective time zones T.

Incidentally, in a case of using relative errors as an evaluation index for determination of priority orders for applying complement rules in such a manner, the smaller the relative error is, the higher the priority order is determined.

What is claimed is:

1. A statistic traffic information generating apparatus, comprising:

a statistic traffic data storage unit that stores statistic traffic data associated with road links;

a missing link extraction unit that extracts a missing link whose statistic traffic data is partially missing from the statistic traffic data storage unit;

a complement rule storage unit that stores complement rules associated with an extraction of a complementary road link to be used to complement a missing part of the statistic traffic data of the missing link;

a candidate link extraction unit that extracts candidate links to be candidates of the complementary road link extracted by the extraction unit, according to the complement rules stored in the complement rule storage unit;

a calculation unit that calculates a degree of similarity between the statistic traffic data of the missing link extracted by the missing link extraction unit and the statistic data of the candidate links extracted by the candidate link extraction unit, for the respective complement rules stored in the complement rule storage unit;

a priority order assignment unit that assigns a priority order to the complement rules stored in the complement rule storage unit, according to the degree of similarity calculated by the calculation unit;

a complementary link extraction unit that extracts the complementary link for complement of the missing statistic traffic data, using a complement rule based on the priority order assigned by the priority order assignment unit; and a complement unit that complements the missing part of the statistic traffic data in the statistic traffic data of the missing link extracted by the missing link extraction unit, using the statistic traffic data of the complementary link extracted by the complementary link extraction unit.

2. The statistic traffic information generating apparatus according to claim 1, wherein the calculation unit comprises a sorting unit that sorts the statistic traffic data, using at least one item of day type and time sectioning that divides one day into plural time zones, wherein the calculation unit calculates the degree of similarity for the respective statistic traffic data sorted by the sorting unit.

3. The statistic traffic information generating apparatus according to claim 1, wherein the calculation unit comprises:

an average traffic data calculation unit that calculates an average traffic data of the statistic traffic data of the candidate links, more than one of which is extracted by the candidate link extraction unit in each of the complement rules;

a correlation coefficient calculation unit that calculates a correlation coefficient between the statistic traffic data of a significant part of the missing link and the average traffic data calculated by the average traffic data calculation unit in each of the complement rules; and a relative error calculation unit that calculates relative errors between the average traffic data calculated by the average traffic data calculation unit and the statistic traffic data of a significant part of the missing link, and calculates inverses of the respective relative errors, for the respective complement rules stored in the complement rule storage unit, wherein the calculation unit calculates the degree of similarity, based on a value of either the correlation coefficient calculated by the correlation coefficient calculation unit or the inverses of the relative errors calculated by the relative error calculation unit.

4. The statistic traffic information generating apparatus according to claim 1, further comprising:

a congestion frequency calculation unit that calculates a congestion frequency for each road link, based on the statistic traffic data associated with the road link;

a bottleneck identification unit that identifies a bottleneck connection point between road links connected with each other, using the congestion frequency calculated by the congestion frequency calculation unit; and a filtering unit that eliminates an outflow link at the connection point identified by the bottleneck identification unit in a case where the missing link extracted by the missing link extraction unit is an inflow link, or an inflow link at the connection point identified by the bottleneck identification unit in a case where the missing link extracted by the missing link extraction unit is an outflow link, from a candidate link extracted by the candidate link extraction unit, with respect to the connection points of the road links identified by the bottleneck identification unit.

5. A method of generating statistic traffic information, comprising:

a statistic traffic data storage process that stores statistic traffic data associated with road links;

a missing link extraction process that extracts a missing link whose statistic traffic data is partially missing from the statistic traffic data storage process;

a complement rule storage process that stores complement rules associated with an extraction of a complementary link to be used to complement a missing part of the statistic traffic data of the missing link;

a candidate link extraction process that extracts candidate links to be candidates of the complement link, according to the complement rules stored in a complement rule storage unit;

a calculation process that calculates a degree of similarity between the statistic traffic data of the missing link extracted by the missing link extraction process and the statistic data of the candidate links being extracted by the candidate link extraction process, for the respective complement rules stored in the complement rule storage unit;

a priority order assignment process that assigns a priority order to the complement rules stored in the complement rule storage unit, according to the degree of similarity calculated by the calculation process;

a complementary link extraction process that extracts the complementary link for complement of the missing statistic traffic data, using a complement rule based on the priority order assigned by the priority order assignment process; and a complement process that complements the missing part of the statistic traffic data in the statistic traffic data of the missing link extracted by the missing link extraction process, using the statistic traffic data of the complementary link extracted by the complementary link extraction process.

6. The method of generating statistic traffic information according to claim 5, wherein the calculation process performs:

a sorting process that sorts the statistic traffic data, using at least one item of day type and time-sectioning that divides one day into plural time zones; and a calculation process that calculates the degree of similarity for the respective statistic traffic data sorted by the sorting process.

7. The method of generating statistic traffic information according to claim 5, wherein the calculation process performs:

an average traffic data calculation process that calculates an average traffic data of the statistic traffic data of the candidate links, more than one of which is extracted by the candidate link extraction process in each of the complement rules;

a correlation coefficient calculation process that calculates a correlation coefficient between the statistic traffic data of a significant part of the missing link extracted by the complementary link extraction process and the average value calculated by the average value calculation unit; and a relative error calculation process that calculates relative errors between the average traffic data calculated by the average traffic data calculation process and the statistic traffic data of a significant part of the missing link, and calculates inverses of the respective relative errors, for the respective complement rules stored in the complement rule storage unit; and a process that calculates the degree of similarity, based on a value of either the correlation coefficient calculated by the correlation coefficient calculation process or the inverses of the respective relative errors calculated by the relative error calculation process.

8. The method of generating statistic traffic information according to claim 5, further comprising:

a congestion frequency calculation process that calculates a congestion frequency for each road link, based on the statistic traffic data associated with the road link;

a bottleneck identification process that identifies a bottleneck connection point between road links connected with each other, using the congestion frequency calculated by the congestion frequency calculation process; and a filtering process that eliminates an outflow link at the connection point identified by the bottleneck identification process in a case where the missing link by the extraction process is an inflow link, or an inflow link at the connection point identified by the bottleneck identification process in a case where the missing link extracted by the missing link extraction process is an outflow link, from a candidate link extracted by the candidate link extraction process, with respect to the connection points of the road links identified by the bottleneck identification process.

* * * * *